US005430631A

United States Patent [19]

Dick

[11] Patent Number: 5,430,631

[45] Date of Patent: Jul. 4, 1995

[54] YARD LANTERN

[76] Inventor: Raymond P. Dick, 15016 FM 2100, Crosby, Tex. 77532

[21] Appl. No.: 216,305

[22] Filed: Mar. 23, 1994

[51] Int. Cl.[6] ..... F21V 11/00

[52] U.S. Cl. ..... 362/354; 362/216; 362/414; 362/806; 362/351; D26/101; D6/332

[58] Field of Search ..... 362/216, 351, 354, 410, 362/414, 806; D26/101, 58; D25/130, 132; D6/332, 450

[56] References Cited

U.S. PATENT DOCUMENTS

| | | | |
|---|---|---|---|
| 1,106,631 | 8/1914 | Davis, Jr. | 362/351 |
| 2,857,027 | 10/1958 | Lindman | D25/132 |
| 3,115,958 | 5/1961 | Sabel et al. | D25/130 |
| 4,104,713 | 8/1978 | Chan et al. | 362/294 |
| 4,234,916 | 11/1980 | Goralnik | 362/294 |
| 4,536,831 | 8/1985 | English et al. | 362/263 |

FOREIGN PATENT DOCUMENTS

| | | | |
|---|---|---|---|
| 2186502 | 1/1990 | Japan | 362/216 |

*Primary Examiner*—Ira S. Lazarus
*Assistant Examiner*—Sara Raab
*Attorney, Agent, or Firm*—Thomas R. Vigil

[57] ABSTRACT

The indoor/outdoor lantern comprises a lamp base mounting a lamp socket, electric wire conductors extending from the lamp socket for connection to a source of electrical current, a lamp enclosure including an ornamental grillwork or grating surrounding the lamp and extending between an upper end thereof and a lower end thereof which forms a support for the lantern, a cover for the lantern, the lamp base being mounted inside the lantern cover whereby said lamp socket depends from the cover. The grillwork or grating has a pleasing ornamental appearance which cast pretty shadows. For example the grillwork or grating can include an ornamental outline of vegetation, and more specifically of vines or branches having leaves or flowers.

10 Claims, 3 Drawing Sheets

YARD LANTERN

BACKGROUND OF THE INVENTION

1. Field of the Invention

The present invention relates to an indoor/outdoor lamp or lantern finding specific use as an outdoor yard lantern and comprising an electric lamp and an enclosure for the lamp including a grating or grillwork having an ornamental outline, such as an ornamental outline of vegetation, and more specifically of vines or branches and leaves or flowers.

2. Description of the Related Art Including Information Disclosed Under 37 CFR §§ 1.97–1.99.

Heretofore, a large variety of lamps for indoor use and outdoor use have been proposed.

A typical outdoor lamp has a glass framework that is hermetically sealed to a base to prevent water, snow or ice from entering the lamp.

As will be described in greater detail hereinafter, the yard lantern of the present invention does not include a glass enclosure or lens that is hermetically sealed to the base of the lamp. Instead, the yard lantern of the present invention includes an ornamental grillwork or grating which surrounds a lamp with the lamp depending from an inside top cover of the lantern.

SUMMARY OF THE INVENTION

According to the present invention there is provided an outdoor lantern comprising a non-electrically conductive lamp base mounting a lamp socket for receiving a lamp, electric wire conductors extending from the lamp socket for connection to a source of electrical current, and a lamp enclosure which is made of metal and which is generally rectangular in cross section having four sides, each side including at least a section of a column of an ornamental, decorative grillwork or grating, the enclosure surrounding the lamp socket and extending between an upper end of the enclosure and a lower end of the enclosure. The lower end forms a support for the lantern. The upper end forms a support for the lamp base with the lamp socket depending from the base. A cover for the lantern is received over the base. The lamp base is mounted beneath the lantern cover whereby the lamp socket depends from the cover. The decorative column sections of the grillwork or grating each have a pleasing ornamental, decorative appearance which casts pretty shadows and which is selected from the class consisting essentially of: an ornamental outline of vegetation, an ornamental outline of vines, an ornamental outline of branches having leaves, an ornamental outline of branches having flowers, an ornamental outline of a grapevine, an ornamental outline of a vine of roses, an ornamental outline of a branch of oak leaves, an ornamental outline of bamboo shoots and leaves, and a bird of paradise ornamental pattern.

DESCRIPTION OF THE PREFERRED EMBODIMENT(S)

Figure 1:
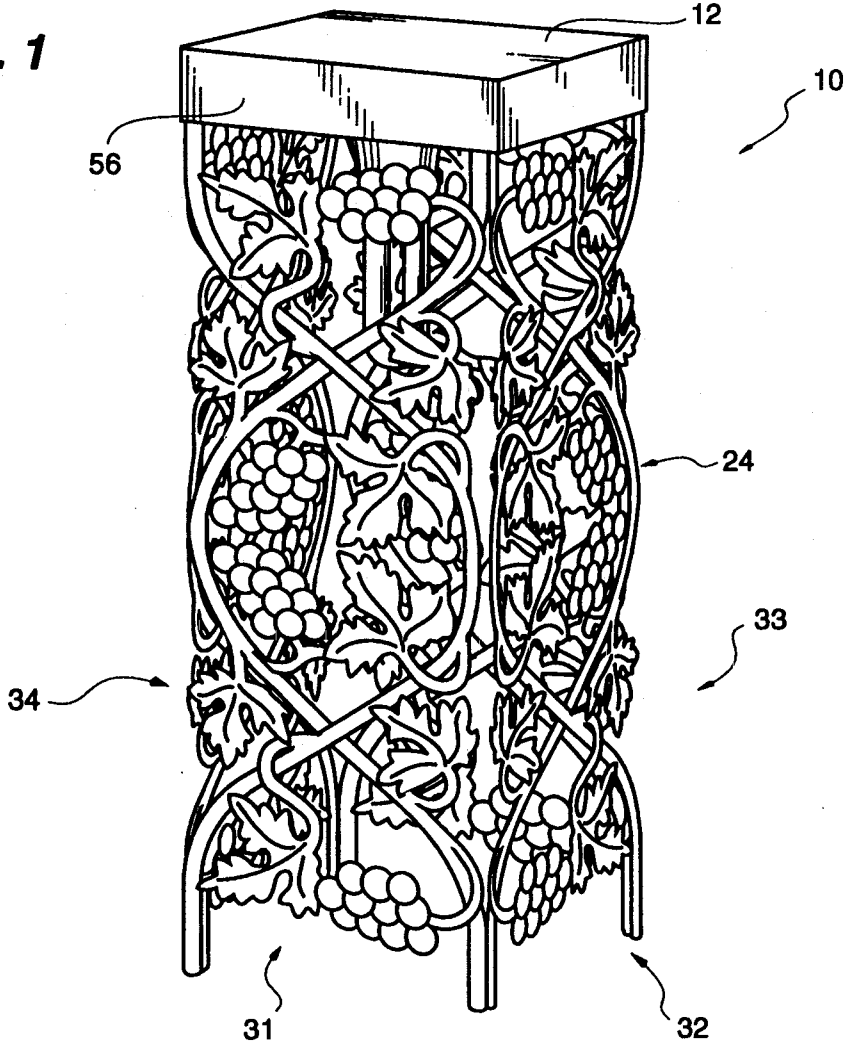
FIG. 1 is a perspective elevational view of an indoor-/outdoor lamp or lantern constructed according to the teachings of the present invention.

Referring now to the drawings in greater detail there is illustrated in FIG. 1 an indoor/outdoor lantern 10 or simply yard lantern 10 constructed according to the teachings of the present invention.

In the illustrated embodiment, the yard lantern 10 includes a generally square cover 12 in which there is mounted a base 14, which is preferably made of plywood, for a lamp socket 16 which is mounted to and depends from the base 14 and which receives a lamp 16. The lamp socket 16 includes wire conductors 21 and 22 (FIG. 2) which extend down from the lamp socket 16 to a connection to a source of electrical energy, such as an 115 volt AC source.

According to the teachings of the present invention, the lantern 10 includes an enclosure, shell, casing or framework 24 surrounding the lamp socket 16 and including four sides 31–34, each of which is made from a grillwork or grating, such as a cast aluminum grillwork or grating having a pleasing ornamental appearance which cast pretty shadows. For example each of the decorative grillwork or grating sides 31–34 can include an ornamental outline of vegetation, and more specifically of vines or branches having leaves or flowers. Then, light from the lamp 18 mounted in the lamp socket 16 and passing through the grillwork or grating sides 31–34 can create artistic, aesthetic and pleasing looking shadows in the surrounding area.

Figure 2:
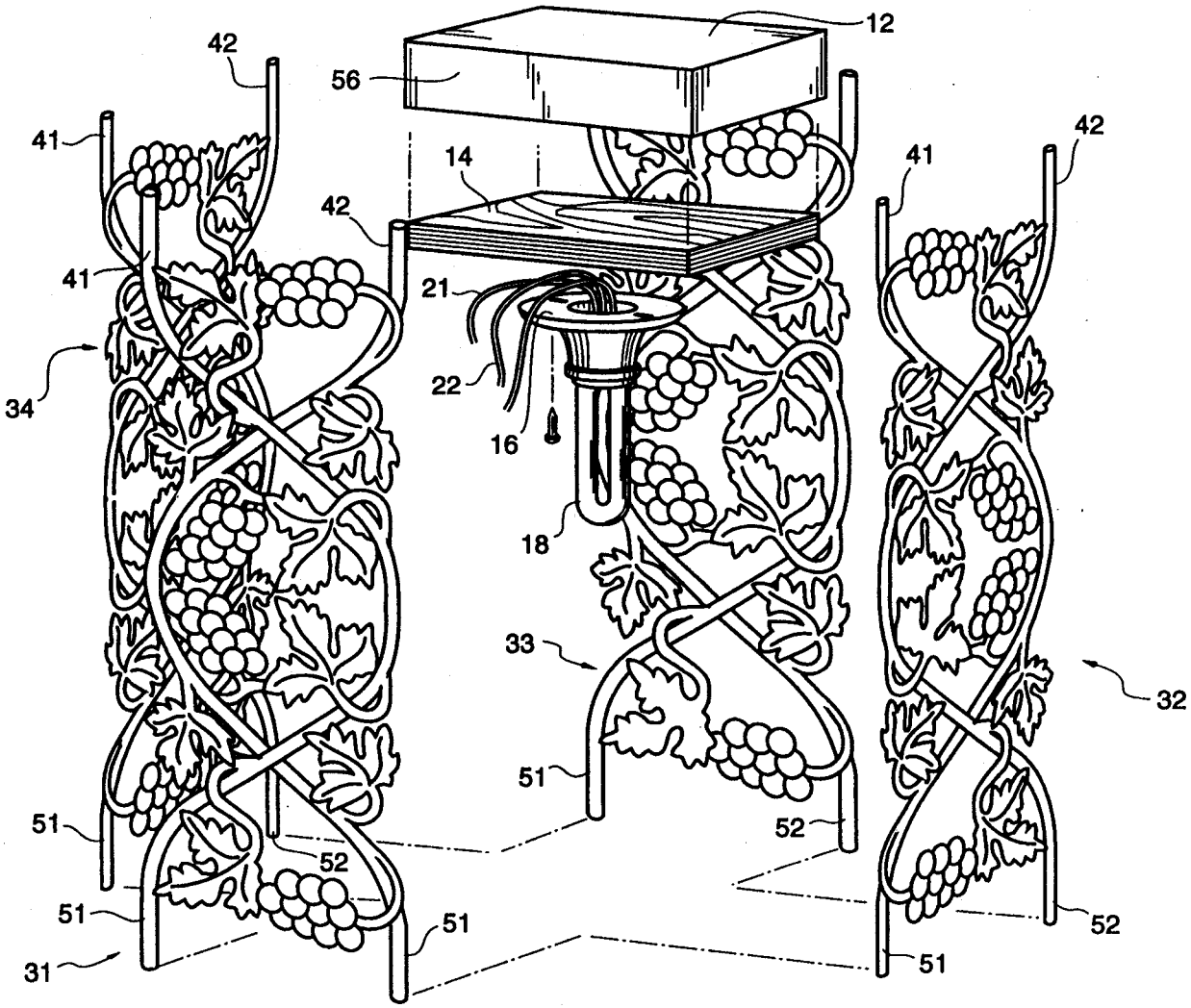
FIG. 2 is a perspective exploded view of the lantern shown in FIG. 1.
Figure 3:
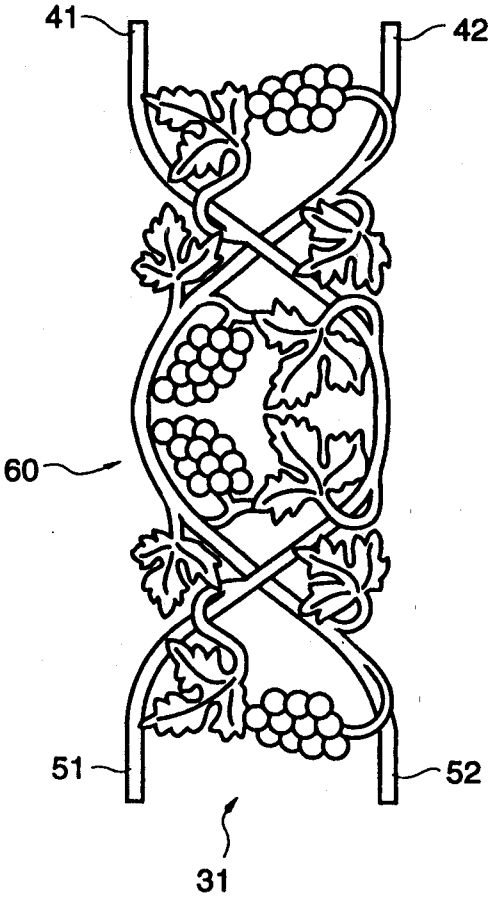
FIG. 3 is a side elevational view of one side of the lantern shown in FIG. 1 which side is a piece of grating or grillwork having an ornamental design of a grapevine.

In the illustrated embodiment, the lantern 10 includes four elongate grating or grillwork sides 31–34 which have a grapevine pattern as shown in FIGS. 1, 2 and 3. The four rectangular gratings of grillwork sides 31–34 having the decorative grapevine pattern therein are connected together, such as by welding or brazing, at side edges 36 and 38 where they come close to or touch each other. With the grapevine pattern each side 31–34 right and left upper legs 41 and 42 and right and left lower legs 51 and 52. The adjacent legs in adjacent sides can be connected together and the lower legs 51 and 52 can form and serve as support legs.

The side gratings or pieces of grillwork 31–34 are typically cast aluminum gratings used for corner columns for a porch or entrance way to a house. Such decorative rectangular pieces of grating or grillwork having the decorative patterns shown in FIGS. 1–7 can be obtained from the Moultrie Manufacturing Company in Moultrie, Ga.

Referring now to FIG. 2, the electric lamp socket 16 can be of the type sold by Crescent Electric Supply Company of Elgin, Ill. under Catalog No. FLA7DX/SPX27/5DKGE "Screw In Adapter".

In one preferred embodiment, the lamp socket 16 is attached to a block of plywood , base 14 which is approximately 7"×7" and approximately one inch thick. The underside of this plywood base 14 is suitably cut out to provide channels or passageways for the electrical wire conductor 21 and 22 which are fed down along one of the vines of the grapevine pattern sides and to a receptacle or are connected directly to a source of 110/120 volt AC power supply.

As shown, the lamp 18 is a U-shaped fluorescent type lamp or a halogen type lamp having a U-shape.

The cover 12 for the yard lantern 10 is preferably made of aluminum, is approximately 7½" square and has a depending rim or flange 56 that has a width of approximately one to two inches and, in one preferred embodiment, a width of one and one-half inches.

In one preferred embodiment, the pieces of decorative grating or grillwork having a grapevine pattern 60 (FIG. 3) and forming one of four sides 31–34 of the yard lantern 10 have a length of approximately 21½" and a width of approximately 7½". The gratings or pieces of grillwork 31–34 are cut at the top and the bottom at an area where two intertwining vines or branches are spaced furthest apart to form in each side grating 31–34 of the lamp enclosure 24 the two upper legs 41 and 42 and the two lower legs 51 and 52 which can be welded on their sides to a similar leg in the adjacent side grating, e.g., side 32 or 34.

Although specific dimensions have been stated herein for one preferred embodiment for the lantern 10 it is to be understood that other dimensions can be used. Nonetheless it has been found that a very attractive and workable lantern 10 having a square cross section of 7½" on a side and a height of 21½" provides a very attractive and usable yard lantern 10.

Furthermore, tests of a lantern 10 constructed in this manner in winter conditions have shown that the lantern 10 works adequately casting pretty shadows on the snow surrounding it without damage to the lamp 18 from rain, snow, sleet or ice.

Figure 4:
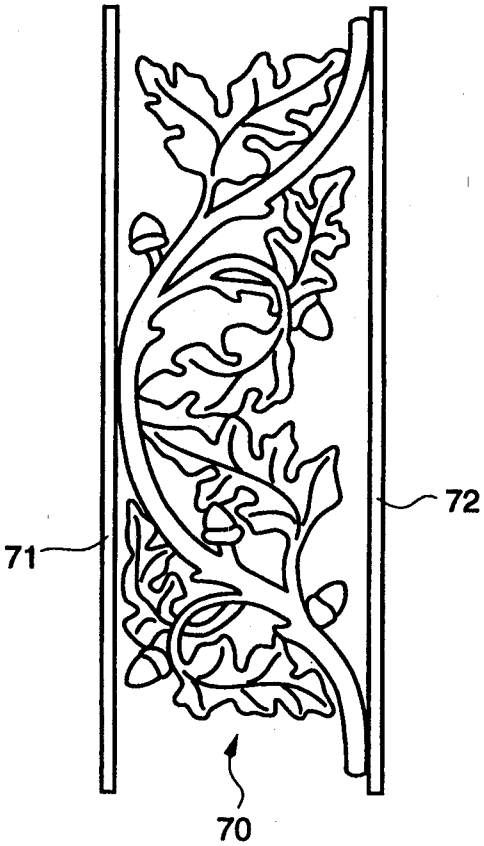
FIG. 4 is a side elevational view of another piece of grating or grillwork having an ornamental design of an oak leaf branch which can be used side for a lantern constructed according to the teachings of the present invention.

It is to be understood that the four side 31–34 of the lantern 10 can be made from different types of decorative gratings or grillwork. For example, and as shown in FIG. 4 the decorative grating or grillwork can be of an oak leaf pattern 70. In this embodiment it may be desirable to provide side rails 71 and 72 which can be fixed along each side edge, such by welding or brazing, to an adjacent side rail 72 or 71 of another side of the enclosure 24.

Figure 7:
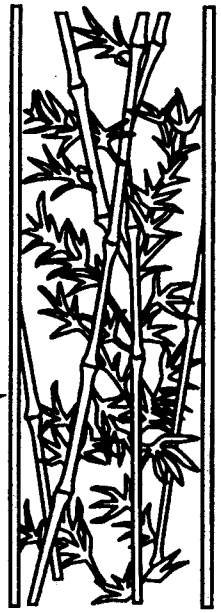
FIG. 7 is a side elevational view of another piece of grating or grillwork having an ornamental design referred to as the bird of paradise design which can be used side for a lantern constructed according to the teachings of the present invention.
Figure 6:
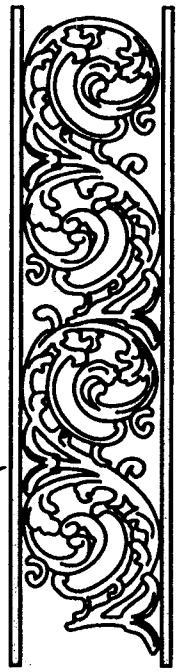
FIG. 6 is a side elevational view of another piece of grating or grillwork having an ornamental design of bamboo branches and leaves which can be used side for a lantern constructed according to the teachings of the present invention.
Figure 5:
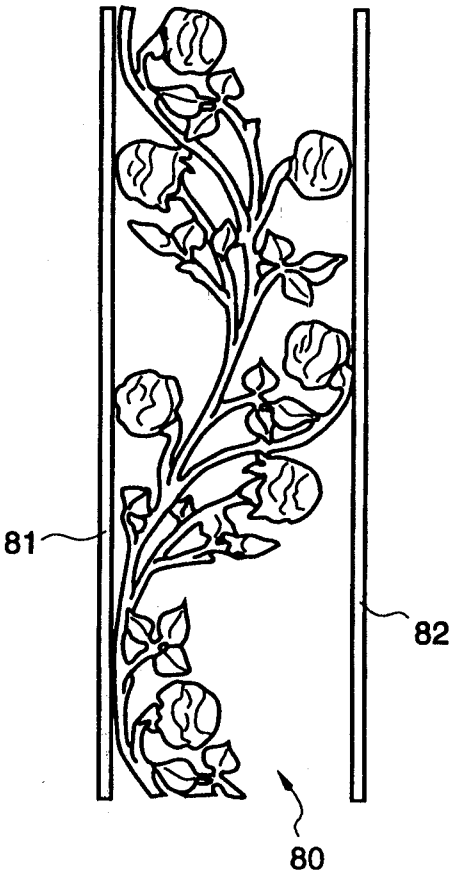
FIG. 5 is a side elevational view of another piece of grating or grillwork having an ornamental design of a vine of roses which can be used side for a lantern constructed according to the teachings of the present invention.

Other patterns which can be used are a rose pattern 80 including an undulating vine following a serpentine path between two rails 81 and 82 as shown in FIG. 5, a bamboo pattern 90 shown in FIG. 6 and a bird of paradise pattern 100 shown in FIG. 7. Again, each of these decorative patterns can be used for sides of the lantern 10 with or without side rails 71 and 72, although side rails may be required with the oak leaf pattern 70 and with the bamboo pattern 90 to provide adjacent contacting points between the framework sides 31–34 forming the enclosure 24 for the lamp socket 16 and lamp 18 and together with the base 14 and cover 12 defining the yard lantern 10.

From the foregoing description, it will be apparent that the indoor/outdoor lantern 10 of the present invention has a number of advantages, some of which have been described above, the casting of pretty aesthetically pleasing shadows, and others of which are inherent in the invention. Also it will be understood that modifications can be made to the yard lantern 10 described above without departing from the teachings of the present invention. Accordingly, the scope of the invention is only to be limited as necessitated by the accompanying claims.

I claim:

1. An outdoor lantern comprising a non-electrically conductive lamp base mounting a lamp socket for receiving a lamp, electric wire conductors extending from said lamp socket for connection to a source of electrical current, a lamp enclosure which is made of metal and which is generally rectangular in cross section having four sides, each side including at least a section of a column of an ornamental, decorative grillwork or grating, said enclosure surrounding said lamp socket and extending between an upper end of said enclosure and a lower end of said enclosure, said lower end forming a support for said lantern, said upper end forming a support for said lamp base with said lamp socket depending from said base, a cover for said lantern received over said base, said lamp base being mounted beneath said lantern cover whereby said lamp socket depends from said cover, and each of said column sections of said grillwork or grating having a pleasing ornamental, decorative appearance which casts pretty shadows and which is selected from the class consisting essentially of: an ornamental outline of vegetation, an ornamental outline of vines, an ornamental outline of branches having leaves, an ornamental outline of branches having flowers, an ornamental outline of a grapevine, an ornamental outline of a vine of roses, an ornamental outline of a branch of oak leaves, an ornamental outline of bamboo shoots and leaves, and a bird of paradise ornamental pattern.

2. The indoor/outdoor lantern of claim 1 wherein said lamp is a florescent lamp.

3. The indoor/outdoor lantern of claim 1 wherein said lamp is a halogen lamp.

4. The indoor/outdoor lantern of claim 1 wherein said lamp has a generally U-shape.

5. The indoor/outdoor lantern of claim 1 wherein said lantern is generally square in cross-section.

6. The lantern of claim 1 wherein said generally rectangular lamp enclosure is approximately seven inches square.

7. The lantern of claim 1 wherein said generally rectangular lamp enclosure is approximately 20 inches high between said lower end and said upper end.

8. The lantern of claim 1 wherein said cover is approximately seven inches square with a depending rim or flange having width between 1 and 2 inches.

9. The lantern of claim 1 wherein said column sections of said grating or grillwork are made of cast aluminum.

10. The lantern of claim 1 wherein said base is approximately 7 inches square.

* * * * *